US006867663B2

(12) United States Patent
Umeda et al.

(10) Patent No.: US 6,867,663 B2
(45) Date of Patent: Mar. 15, 2005

(54) DIELECTRIC DUPLEXER

(75) Inventors: Katsumi Umeda, Katano (JP); Naoki Matsushita, Kadoma (JP); Daisuke Shimizu, Kobe (JP)

(73) Assignees: Sanyo Electric Co., Ltd., Moriguchi (JP); Sanyo Electronic Components Co., Ltd., Daito (JP)

( * ) Notice: Subject to any disclaimer, the term of this patent is extended or adjusted under 35 U.S.C. 154(b) by 105 days.

(21) Appl. No.: 10/457,536

(22) Filed: Jun. 10, 2003

(65) Prior Publication Data

US 2003/0231080 A1 Dec. 18, 2003

(30) Foreign Application Priority Data

Jun. 12, 2002 (JP) ..... 2002-171959

(51) Int. Cl.[7] ..... H01P 5/12; H01P 3/06

(52) U.S. Cl. ..... 333/134; 333/206; 333/219.1; 333/132; 333/202

(58) Field of Search ..... 333/134, 126, 333/129, 132, 202, 206, 219.1

(56) References Cited

U.S. PATENT DOCUMENTS 6,307,448 B1 * 10/2001 Atokawa et al. ..... 333/202
6,359,529 B1 * 3/2002 Tsunoda et al. ..... 333/101
6,677,836 B2 * 1/2004 Uchiyama et al. ..... 333/206
6,696,905 B2 * 2/2004 Umeda et al. ..... 333/206

* cited by examiner

*Primary Examiner*—Daniel D. Chang
(74) *Attorney, Agent, or Firm*—Armstrong, Kratz, Quintos, Hanson & Brooks, LLP

(57) ABSTRACT

The present invention provides a dielectric duplexer 10 comprising a receiving filter 1 and a transmitting filter 2 which are connected in parallel with an antenna connecting terminal portion 17, and both the filters 1, 2 are integrally assembled into a common dielectric block 11. A trap circuit 8 for suppressing a predetermined frequency band different from the receiving band of the receiving filter 1 and from the transmission band of the transmitting filter 2 is integrally assembled into the dielectric block 11 along with the filters 1, 2, and is connected to the antenna connecting terminal portion 17.

6 Claims, 12 Drawing Sheets

(a) (b)

DIELECTRIC DUPLEXER

FIELD OF THE INVENTION

The present invention relates to dielectric duplexers for use in radio communications devices such as portable telephones.

BACKGROUND OF THE INVENTION

Mobile communications systems using a frequency band of hundreds of megahertz to several gigahertz have terminal devices comprising a receiving circuit 91 and a transmitting circuit 92 which are connected in parallel with an antenna 9 via a duplexer 40 to use the single antenna 9 for both receiving and transmitting signals as shown in FIG. 15. The duplexer 40 comprises a receiving filter 1 and a transmitting filter 2, each of which can be provided, for example, by connecting a plurality of coaxial dielectric resonators 50 as shown, for example, in FIG. 16(*a*).

With reference to FIG. 16(*a*), the coaxial dielectric resonator 50 comprises a rectangular parallelepipedal dielectric block 51 having a bore extending therethrough, an outer conductor layer 53 and an inner conductor layer 52 which are formed on the dielectric block 51 respectively over the outer peripheral surface thereof and the inner peripheral surface thereof defining the bore, and a short-circuiting conductor layer 54 formed on the dielectric block 51 over an end face thereof where the bore has an opening and providing a short circuit between the outer conductor layer 53 and the inner conductor layer 52.

With the coaxial dielectric resonator 50, the outer conductor layer 53 is connected to the ground, and the inner conductor layer 52 to a signal input terminal S, whereby the coaxial dielectric resonator 50 is made equivalent to a circuit comprising an inductance element L and a capacitance element C which are connected in parallel with each other as shown in FIG. 16(*b*), thus providing a trap filter having a resonance frequency which is determined by the inductance of the inductance element L and the capacitance of the capacitance element C.

A dielectric duplexer is also made available which comprises a plurality of coaxial dielectric resonators 50 assembled into a single block and providing a receiving filter 1 and a transmitting filter 2 (see U.S. Pat. No. 5,250,916). For example, FIG. 9 shows a dielectric duplexer 40 comprising a plurality of dielectric resonator portions 7*a* to 7*g* which are integrally assembled into a common dielectric block 11.

With reference to FIG. 10, the coaxial dielectric resonator portions 7 have a dielectric block 41, respective inner conductor layers 43 formed on the dielectric block 41 over inner peripheral surfaces thereof defining bores 42 extending through the block 41, an outer conductor layer 44 formed over the outer peripheral surface of the block 41 and a short-circuiting conductor layer 45 providing a short circuit between the outer conductor layer 44 and the inner conductor layers 43.

A conductor pattern 46 is formed on the dielectric block 41 over one end face thereof where the bores of the resonator portions 7 each have an opening, for connecting the resonator portions to one another. As shown in FIG. 9, the conductor pattern 46 comprises a plurality of conductor pattern pieces 21 to 27 provided for the respective resonator portions 7 and each extending from the opening edge around the bore outwardly thereof, a conductor pattern piece 47 connectable to an antenna, a conductor pattern piece 28 connectable to a receiving circuit, and a conductor pattern piece 29 connectable to a transmitting circuit.

FIG. 11 shows a circuit equivalent to the dielectric duplexer 40. As illustrated, the receiving filter 1 and the transmitting filter 2 are connected in parallel with an antenna connecting terminal portion ANT. The receiving filter 1 comprises a filter circuit 3 having a pass band in the frequency band of the signals to be received, and a trap circuit 4 for suppressing the frequency band of the signals to be transmitted. The transmitting filter 2 comprises a filter circuit 5 having a pass band in the frequency band of the signals to be transmitted, and a trap circuit 6 for suppressing the frequency band of the signals to be received.

A connecting terminal Rx for the receiving side is provided at a connection between the filter circuit 3 of the receiving filter 1 and the trap circuit 4 thereof. A connecting terminal Tx for the transmitting side is provided at a connection between the filter circuit 5 of the transmitting filter 2 and the trap circuit 6 thereof.

The filter circuit 3 of the receiving filter 1 comprises three coaxial dielectric resonator portions 7*a* to 7*c,* and the trap circuit 4 comprising one coaxial dielectric resonator portion 7*f*. Further the filter circuit 5 of the transmitting filter 2 comprises two coaxial dielectric resonator portions 7*d* and 7*e*, and the trap circuit 6 comprising one coaxial dielectric resonator portion 7*g*. Incidentally, each of the coaxial dielectric resonator portions 7 has the same construction as the coaxial dielectric resonator 50 shown in FIG. 16(*a*).

With reference to the circuit shown in FIG. 11 and equivalent to the dielectric duplexer 40, a signal line extending from the antenna connecting terminal portion ANT is provided with nine capacitance elements C1 to C9, which are provided by the conductor pattern 46 formed on one end face of the dielectric block 41 of the duplexer 40 shown in FIG. 9. Stated more specifically, the pair of coaxial dielectric resonator portions 7, 7 to be connected to each other have their conductor pattern pieces positioned close to each other to provide a capacitance between the two conductor pattern pieces.

Cellular phones or portable telephones developed in recent years have various additional functions such as GPS function and radio LAN function. Such portable telephones have a transmitting circuit and a receiving circuit, each of which is provided with a trap circuit for suppressing the operating band of the additional function. However, provision of the trap circuit for each of the transmitting circuit and the receiving circuit entails the problem of necessitating a circuit board of increased size.

SUMMARY OF THE INVENTION

An object of the present invention is to suppress a predetermined frequency band which serves as the operating band of an additional function for use in communications devices without entailing an increase in the size of the circuit board. To fulfill this object, we have conducted intensive research and consequently found that the above object can be achieved advantageously by adding the function of suppressing a predetermined frequency band to a duplexer comprising a receiving filter and a transmitting filter which are connected in parallel with an antenna connecting terminal portion. Thus, the present invention has been accomplished.

The present invention provides a dielectric duplexer of the monoblock type comprising a receiving filter 1 and a transmitting filter 2 which are connected in parallel with an antenna connecting terminal portion 17, both the filters 1, 2 being integrally assembled into a common dielectric block 11, a trap circuit 8 being operable for suppressing a predetermined frequency band different from the receiving band of the receiving filter 1 and from the transmission band of the transmitting filter 2 and being integrally assembled into the dielectric block 11 along with the filters 1, 2, the trap circuit 8 being connected to the antenna connecting terminal portion 17.

When communications devices comprising the dielectric duplexer of the invention receive high-frequency signals, the receiving filter 1 and the trap circuit 8 function, permitting the signal input via the antenna connecting terminal portion 17 to pass through the receiving filter 1, whereby the frequency components other than the receiving band are attenuated, and the trap circuit 8 further suppresses a frequency band serving as the operating band of an additional function. Accordingly, the signals received exert no influence on the operation of the additional function.

Further when the communications device transmits high-frequency signals, the transmitting filter 2 and the trap circuit 8 function for the transmitting filter 2 to pass therethrough the high-frequency signal from a transmitting circuit, whereby the frequency components other than the transmission band are attenuated, with the trap circuit 8 further suppressing the frequency band serving as the operating band of the additional function. Accordingly, the operation of the added function exerts no influence on the signals to be transmitted.

Stated more specifically, the receiving filter 1, the transmitting filter 2 and the trap circuit 8 each comprise one or a plurality of coaxial dielectric resonator portions 7, each of the resonator portions 7 comprising a dielectric block portion which is a part of the dielectric block 11, an inner conductor layer formed on an inner peripheral surface defining a bore extending through the dielectric block portion, an outer conductor layer formed on an outer peripheral surface of the dielectric block portion, and a short-circuiting conductor layer providing a short circuit between the inner conductor layer and the outer conductor layer.

A conductor pattern piece is provided for each resonator portion on the dielectric block 11 on one end face thereof where the bore of the resonator portion has an opening, the conductor pattern piece being joined to the inner conductor layer, each pair of coaxial resonator portions 7, 7 to be connected to each other having their conductor pattern pieces positioned close to each other to provide a capacitance between the conductor pattern pieces for transmitting a high-frequency signal through the capacitance.

The antenna connecting terminal portion 17 is joined to one end of the conductor pattern piece 31 formed on the above-mentioned one end face of the dielectric block 11, and the other end of the conductor pattern piece 31 is positioned close to the conductor pattern piece 30 of the coaxial dielectric resonator portion 7*t* constituting the trap circuit 8 to produce between the conductor pattern pieces a capacitance for transmitting the high-frequency signal therethrough.

Alternatively, the antenna connecting terminal portion 17 is joined to one end of the conductor pattern piece 31 formed on the above-mentioned one end face of the dielectric block 11, and the other end of the conductor pattern piece 31 is joined directly to the conductor pattern piece 30 of the coaxial dielectric resonator portion 7*t* constituting the trap circuit 8 for the transmission of the high-frequency signal.

The arrangement wherein the single trap circuit 8 is connected to the antenna connecting terminal portion 17 is not limitative; a plurality of trap circuits 8*a*, 8*b* for suppressing frequency bands which are different from each other can be connected to the terminal portion 17.

With the dielectric duplexer embodying the present invention described above, a trap circuit 8 for suppressing a predetermined frequency band serving as the operating band of an additional function is integrally incorporated into a dielectric block 11 along with a receiving filter 1 and a transmitting filter 2, hence a duplexer of the monoblock type. Moreover, the single trap circuit 8 is used in common for signal receiving and for signal transmission, so that the duplexer remains unaltered in chip size. Communications devices equipped with the dielectric duplexer of the invention are therefore adapted to suppress a predetermined frequency band serving as the operating band of the additional function without resulting in an increase in the size of the circuit board.

BRIEF DESCRIPTION OF THE DRAWINGS

FIG. 12(*b*) is a graph showing the frequency characteristics of the conventional dielectric duplexer of FIG. 9 in operation for signal receiving;

FIG. 13(*b*) is a graph showing the frequency characteristics of the dielectric duplexer of the invention shown in FIG. 1 in operation for signal receiving;

FIG. 14(*b*) is a graph showing the frequency characteristics of the dielectric duplexer of the invention shown in FIG. 4 in operation for signal receiving;

DETAILED DESCRIPTION OF EMBODIMENTS

With reference to the drawings, a detailed description will be given of the present invention as embodied into a dielectric duplexer for use in portable telephones having a radio LAN function. Incidentally, such portable telephones have a transmission band, for example, of 1.85 to 1.91 GHz and a receiving band, for example, of 1.93 to 1.99 GHz. The radio LAN has an operating band, for example, of 2.4045 to 2.4795 GHz.

Figure 1:
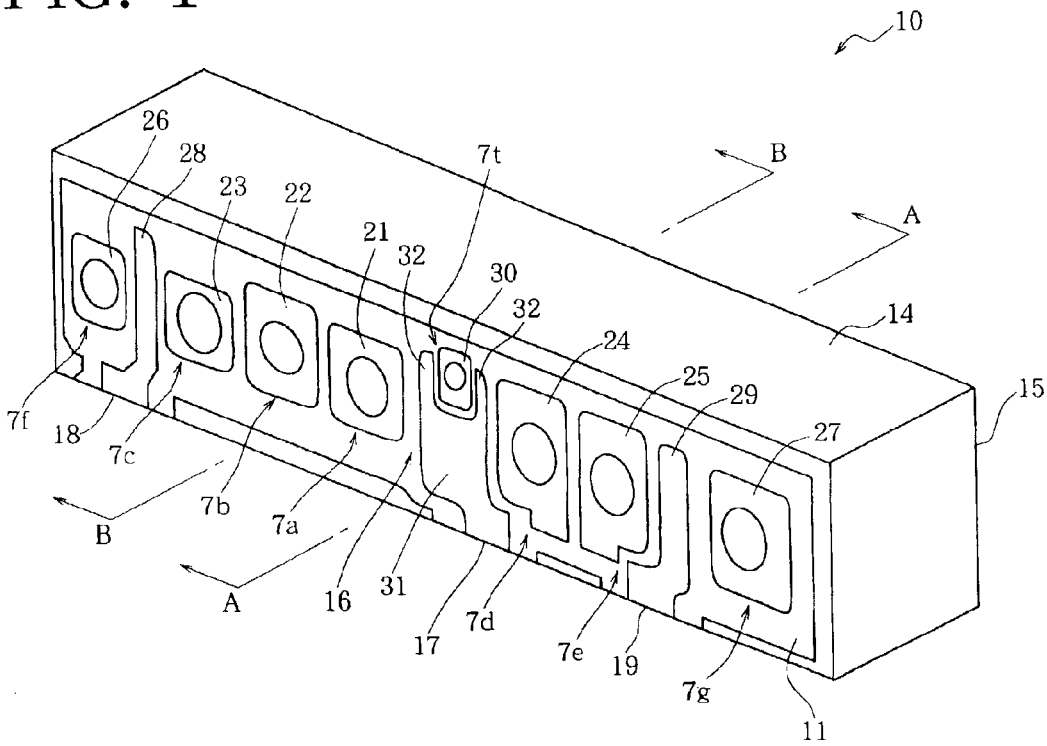
FIG. 1 is a perspective view of a dielectric duplexer according to the invention.

With reference to FIG. 1, the dielectric duplexer 10 embodying the invention comprises eight coaxial dielectric resonator portions 7*a* to 7*g* and 7*t* which are integrally assembled into a rectangular parallelepidal dielectric block 11. The resonator portion 7*t* positioned approximately at the center provides a trap circuit which is characteristic of the invention, the four resonator portions 7*a*, 7*b*, 7*c*, 7*f* at the left of the resonator portion 7*t* constitute a receiving filter, and the three resonator portions 7*d*, 7*e*, 7*g* at the right constitute a transmitting filter.

Figure 3:
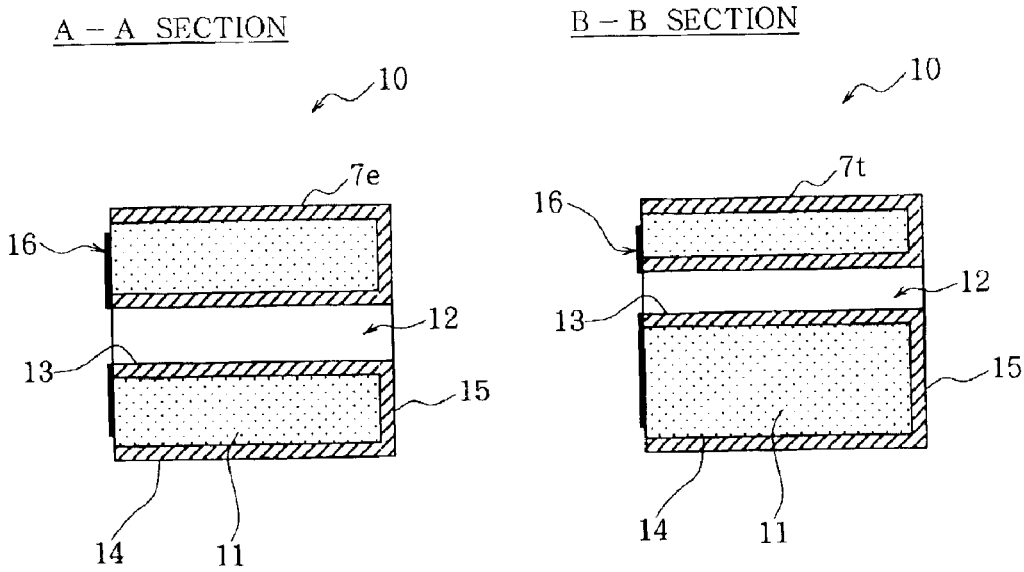
FIG. 3 includes sectional views of the dielectric duplexer.

As shown in FIG. 3, the coaxial dielectric resonator portions 7 comprise a dielectric block 11, inner conductor layers 13 formed on inner peripheral surfaces defining respective bores 12 extending through the block 11, an outer conductor layer 14 formed over the outer peripheral surface of the block 11, and a short-circuiting conductor layer 15 providing short circuit between the outer conductor layer 14 and the inner conductor layers 13.

A conductor pattern 16 is formed on the dielectric block 11 over one end face thereof where the bores of the resonator portions 7 each have an opening, for connecting the seven resonator portions 7*a* to 7*g* to one another. As shown in FIG. 1, the conductor pattern 16 comprises seven rectangular conductor pattern pieces 21 to 27 provided for the respective resonator portions 7 and each extending from the opening edge around the bore outwardly thereof, a striplike conductor pattern piece 31 connectable to an antenna, a striplike conductor pattern piece 28 connectable to a receiving circuit, and a striplike conductor pattern piece 29 connectable to a transmitting circuit.

Figure 2:
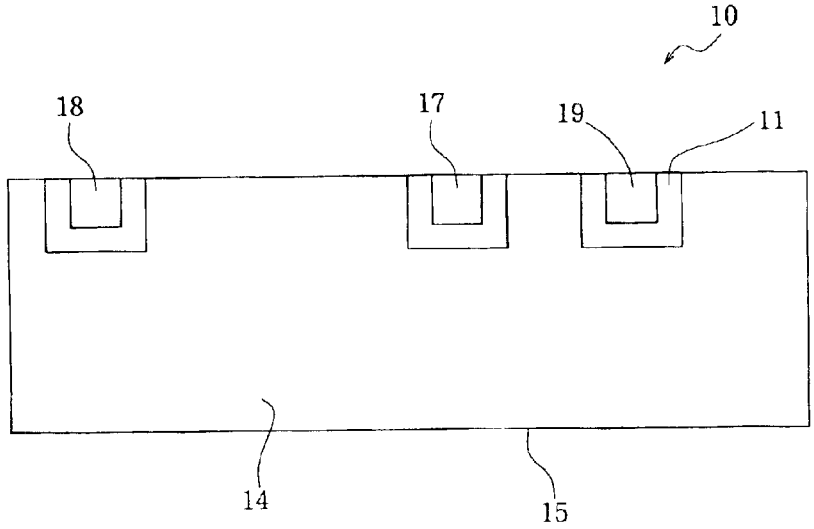
FIG. 2 is a rear view of the dielectric duplexer.

The three conductor pattern pieces 31, 28, 29 each in the form of a strip are connected respectively to an antenna connecting terminal portion 17, receiving-side connecting terminal portion 18 and transmitting-side connecting terminal portion 19 which are provided on the rear surface of the block 11 as shown in FIG. 2.

Figure 6:
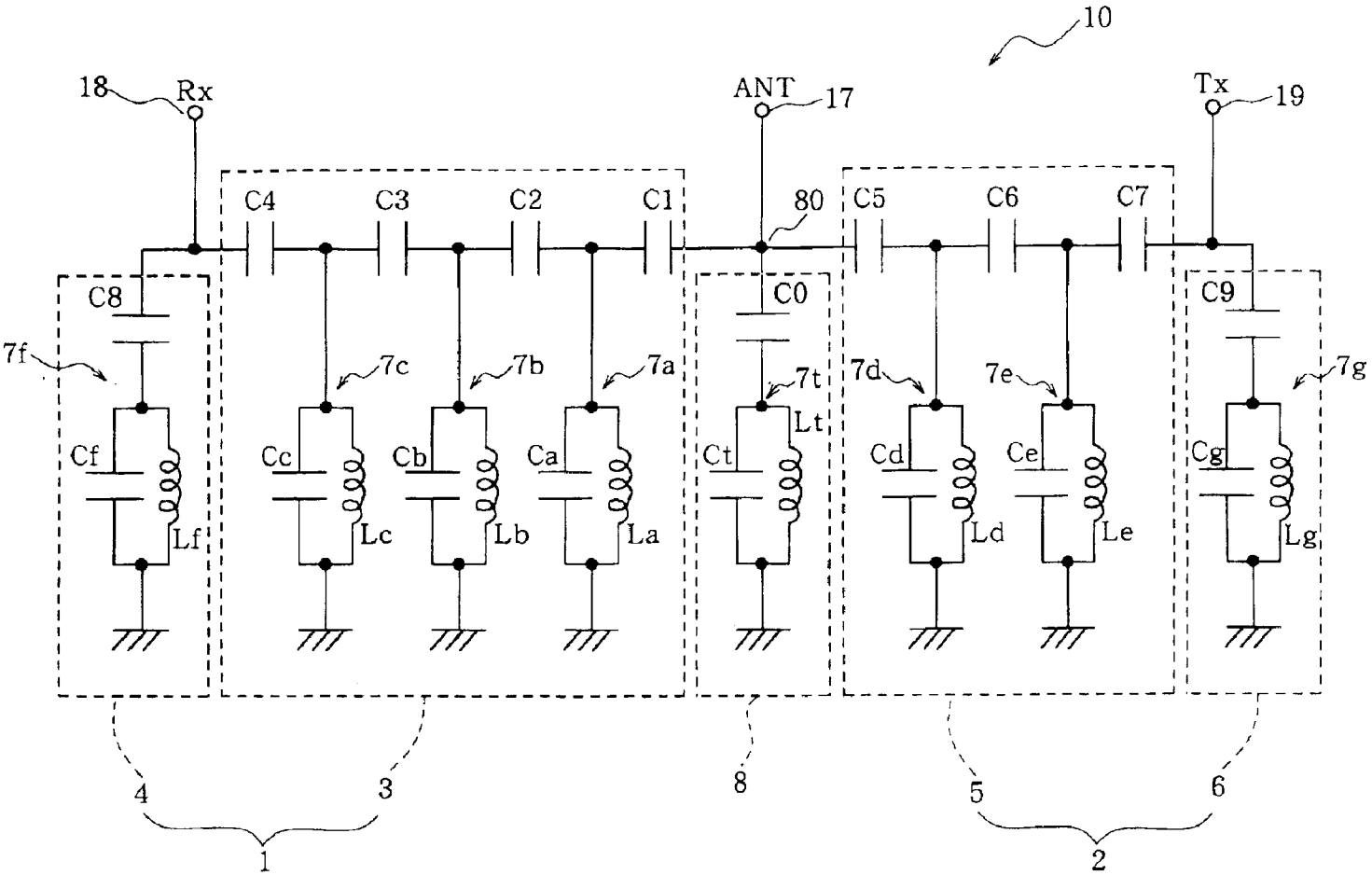
FIG. 6 is a diagram showing a circuit equivalent to the dielectric duplexer shown in FIG. 1.

FIG. 6 shows a circuit equivalent to the dielectric duplexer 10. As illustrated, a receiving filter 1 and a transmitting filter 2 are connected in parallel with an antenna connecting terminal portion ANT 17. The receiving filter 1 comprises a filter circuit 3 having a pass band in the frequency band of the signals to be received, and a trap circuit 4 for suppressing the frequency band of the signals to be transmitted. The transmitting filter 2 comprises a filter circuit 5 having a pass band in the frequency band of the signals to be transmitted, and a trap circuit 6 for suppressing the frequency band of the signals to be received.

Provided at a connection 80 of the receiving filter 1 and the transmitting filter 2 with the antenna terminal portion 17 is a trap circuit 8 for suppressing a predetermined frequency band different from the receiving band of the receiving filter 1 and from the transmission band of the transmitting filter 2.

A connecting terminal portion Rx 18 for the receiving side is provided at a connection between the filter circuit 3 of the receiving filter 1 and the trap circuit 4 thereof. A connecting terminal portion Tx 19 for the transmitting side is provided at a connection between the filter circuit 5 of the transmitting filter 2 and the trap circuit 6 thereof.

The filter circuit 3 of the receiving filter 1 comprises three coaxial dielectric resonator portions 7*a* to 7*c*, and the trap circuit 4 comprising one coaxial dielectric resonator portion 7*f*. Further the filter circuit 5 of the transmitting filter 2 comprises two coaxial dielectric resonator portions 7*d* and 7*e*, and the trap circuit 6 comprising one coaxial dielectric resonator portion 7*g*. The trap circuit 8 comprises one coaxial dielectric resonator portion 7*t*.

The coaxial dielectric resonator portions 7*a* to 7*g* providing the receiving filter 1 and the transmitting filter 2 each have their capacitance and inductance so designed as to give the filter specified filter characteristics. The resonator portion 7*t* providing the trap circuit 8 has a capacitance and an inductance which are so designed as to give trap characteristics in the frequency band of the radio LAN which band is different from the receiving band of the receiving filter 1 and from the transmission band of the transmitting filter 2.

In the equivalent circuit shown in FIG. 6 of the dielectric duplexer 10, three signal lines extending from the antenna connecting terminal portion 17 are provided with ten capacitance elements C0 to C9, which are provided by the conductor pattern 16 formed over one end face of the dielectric block 11 of the duplexer 10 shown in FIG. 1.

Stated more specifically, the conductor pattern piece 31 extending from the antenna connecting terminal portion 17 is bifurcated at its end into a pair of arms 32, 32, which are positioned at opposite sides of a conductor pattern piece 30 of the coaxial dielectric resonator portion 7*t*, providing the capacitance element C0 between the conductor pattern pieces 31, 30. Furthermore, the arms 32, 32 of the conductor pattern piece 31 are positioned close to the conductor pattern pieces 21, 24 of the respective resonator portions 7*a*, 7*d* which are positioned on opposite sides of the arms 32, 32 to constitute the capacitance element C1 between the conductor patterns 30, 21 which are close to each other, and constitute the capacitance element C5 between the conductor patterns 30, 24 which are close to each other.

Similarly, the capacitances C2, C3, C6 are provided between the respective adjacent pairs of five coaxial dielectric resonator portions 7*a* to 7*e* providing the filter circuits 3, 5.

With reference to FIG. 1, the conductor pattern piece 28 extending from the receiving-side connecting terminal portion 18 extends between the conductor pattern piece 23 of the resonator portion 7*c* constituting the filter circuit 3 and the conductor pattern piece 26 of the resonator portion 7*f* constituting the trap circuit 4, providing the capacitance C4 between the conductor pattern pieces 28, 23 which are adjacent to each other and providing capacitance C8 between the conductor pattern pieces 28, 26 which are adjacent to each other.

Further the conductor pattern piece 29 extending from the transmitting-side connecting terminal portion 19 extends between the conductor pattern piece 25 of the resonator portion 7*e* constituting the filter circuit 5 and the conductor pattern piece 27 of the resonator portion 7*g* constituting the trap circuit 6, providing the capacitance C7 between the conductor pattern pieces 29, 25 which are adjacent to each other and providing capacitance C9 between the conductor pattern pieces 29, 27 which are adjacent to each other.

Thus, to provide the dielectric duplexer 10 of the monoblock type according to the invention, assembled into a common dielectric block 11 are three coaxial dielectric resonator portions 7*a* to 7*c* constituting the filter circuit 3 of the receiving filter 1, one coaxial dielectric resonator portion 7*f* providing the trap circuit 4, two coaxial dielectric resonator portions 7*d* and 7*e* constituting the filter circuit 5 of the transmitting filter 2, one coaxial dielectric resonator portion 7*g* providing the trap circuit 6, and one coaxial dielectric resonator portion 7*t* providing the trap circuit 8.

Figure 4:
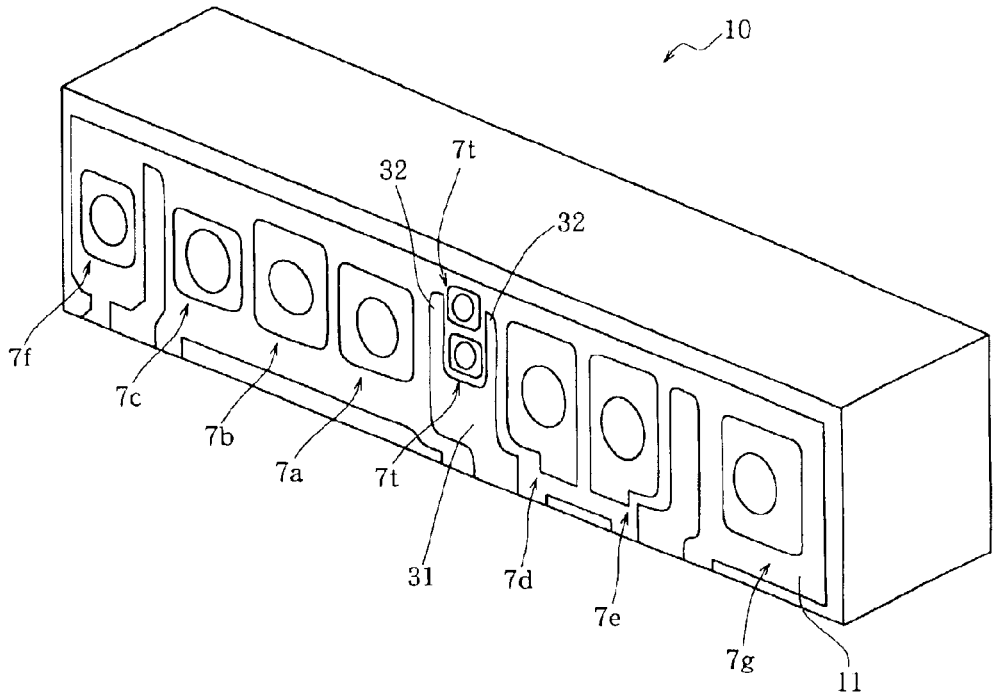
FIG. 4 is a perspective view of another dielectric duplexer according to the invention.
Figure 7:
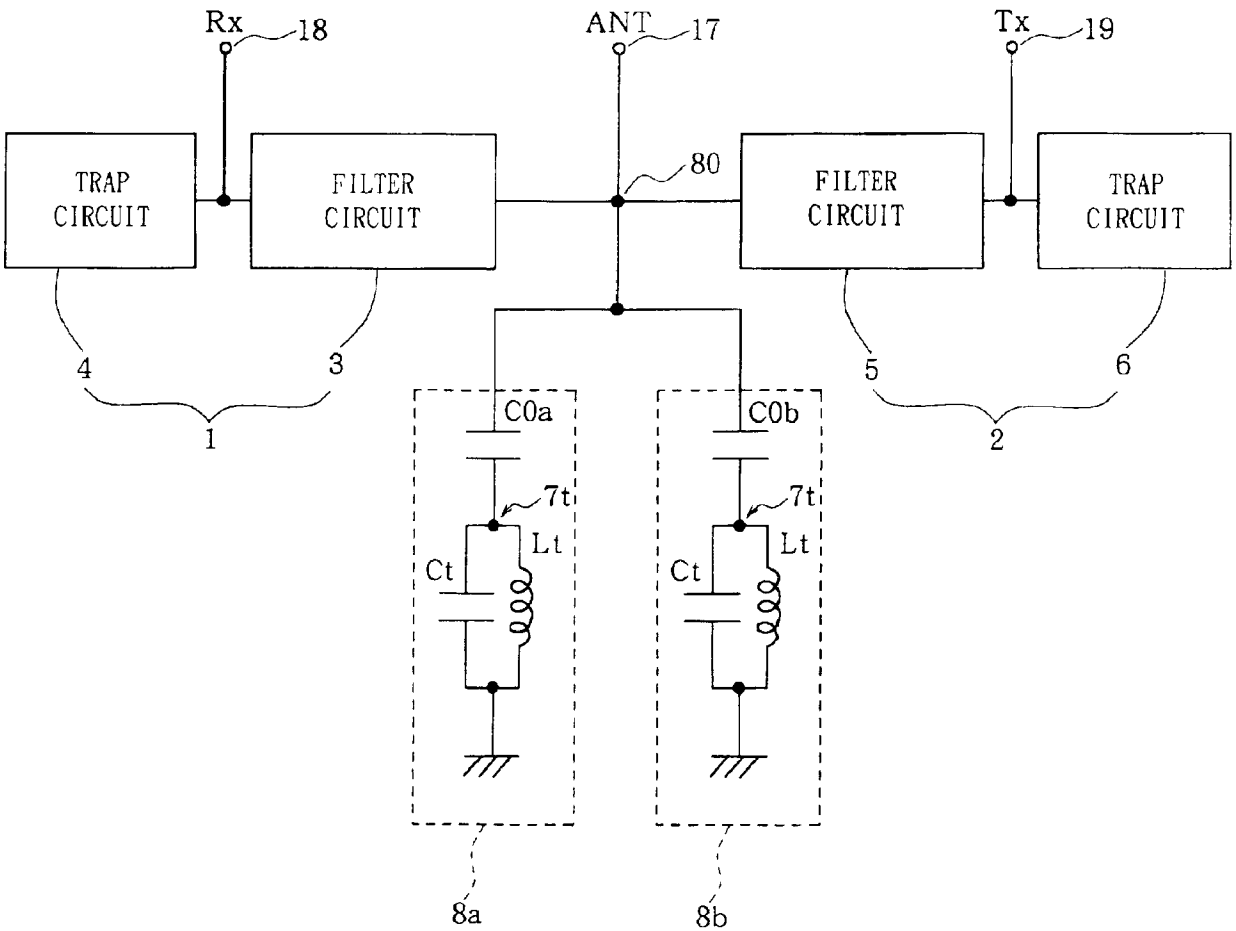
FIG. 7 is a diagram showing a circuit equivalent to the dielectric duplexer shown in FIG. 4.

FIG. 4 shows a dielectric duplexer 10 which comprises a pair of coaxial dielectric resonator portions 7*t*, 7*t* in order to realize trap characteristics in the radio LAN frequency band which is different from the receiving band and the transmission band. FIG. 7 shows a circuit equivalent to this dielectric duplexer 10.

With reference to FIG. 7, a pair of trap circuits 8*a*, 8*b* are connected in parallel with a connection 80 between a receiving filter 1 and a transmitting filter 2. The pair of coaxial dielectric resonator portions 7*t*, 7*t* provide the trap circuits 8*a*, 8*b*. These trap circuits 8*a*, 8*b* are different in coupling capacitance (COa≠COb) since the position of the pair of resonator portions 7*t*, 7*t* are different relative to the arms 32, 32 of the conductor pattern piece 31, and the trap circuits 8*a*, 8*b* are different from each other in the frequency band to be suppressed, consequently realizing trap characteristics over a wide frequency band.

Figure 5:
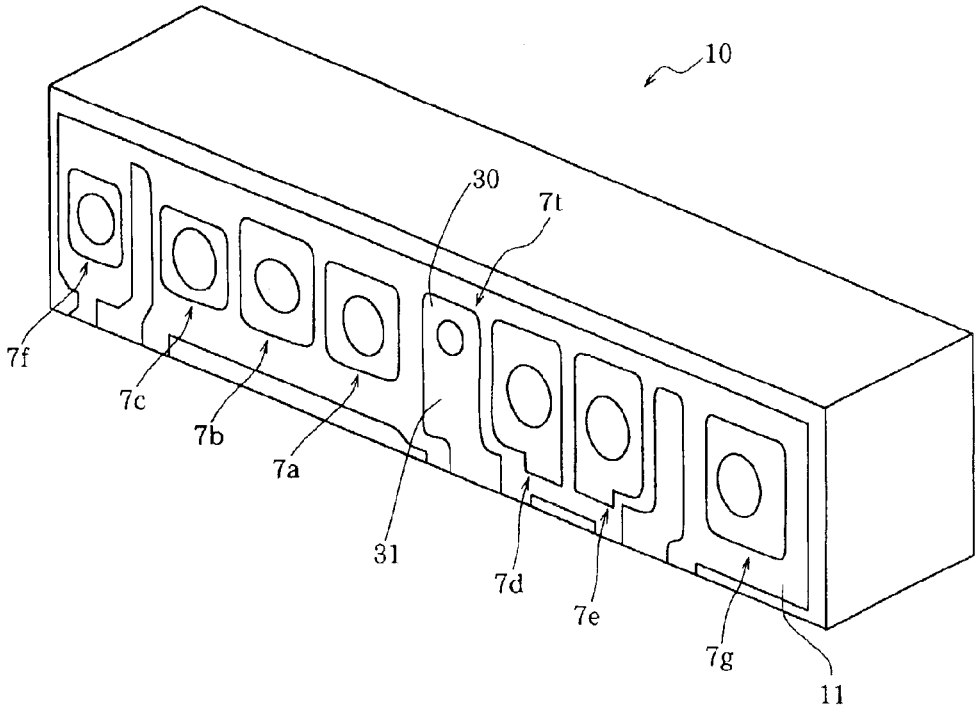
FIG. 5 is a perspective view of another dielectric duplexer according to the invention.
Figure 8:
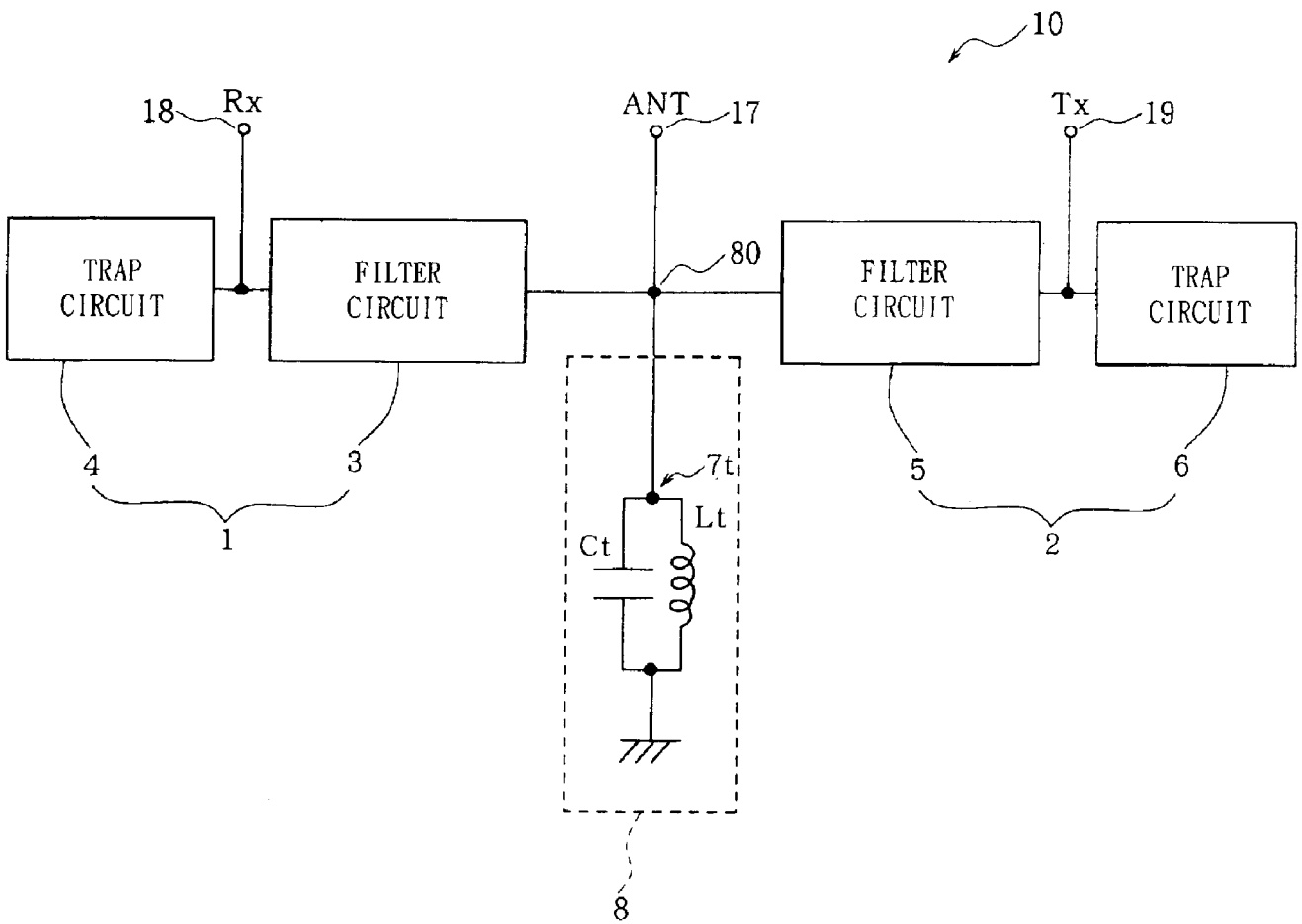
FIG. 8 is a diagram showing a circuit equivalent to the dielectric duplexer shown in FIG. 5.

FIG. 5 shows a dielectric duplexer 10 wherein the conductor pattern piece 31 to be connected to an antenna connecting terminal is directly joined to the conductor pattern piece 30 of a coaxial dielectric resonator portion 7*t* constituting a trap circuit. FIG. 8 shows a circuit equivalent to this duplexer 10. With reference to FIG. 8, the trap circuit 8 is connected directly to a connection 80 between a receiving filter 1 and a transmitting filter 2.

Figure 9:
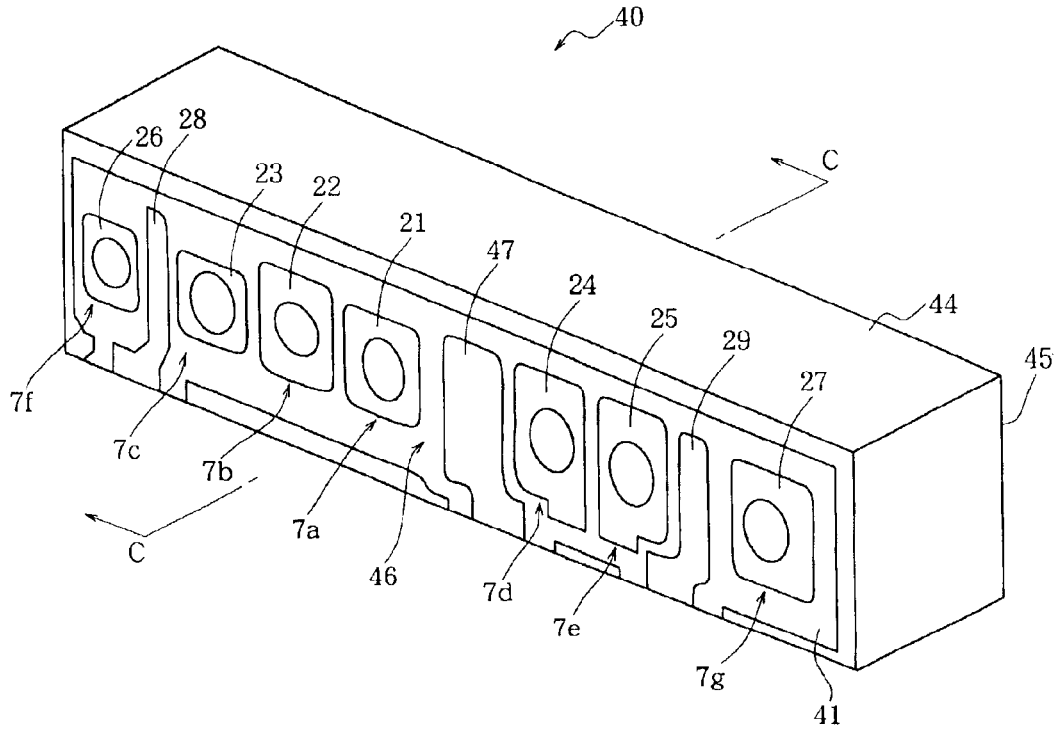
FIG. 9 PRIOR ART
FIG. 9 is a perspective view of a conventional dielectric duplexer.
Figure 10:
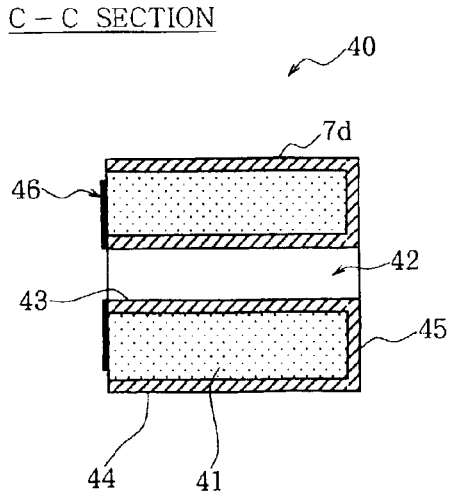
FIG. 10 is a sectional view of the dielectric duplexer.
Figure 11:
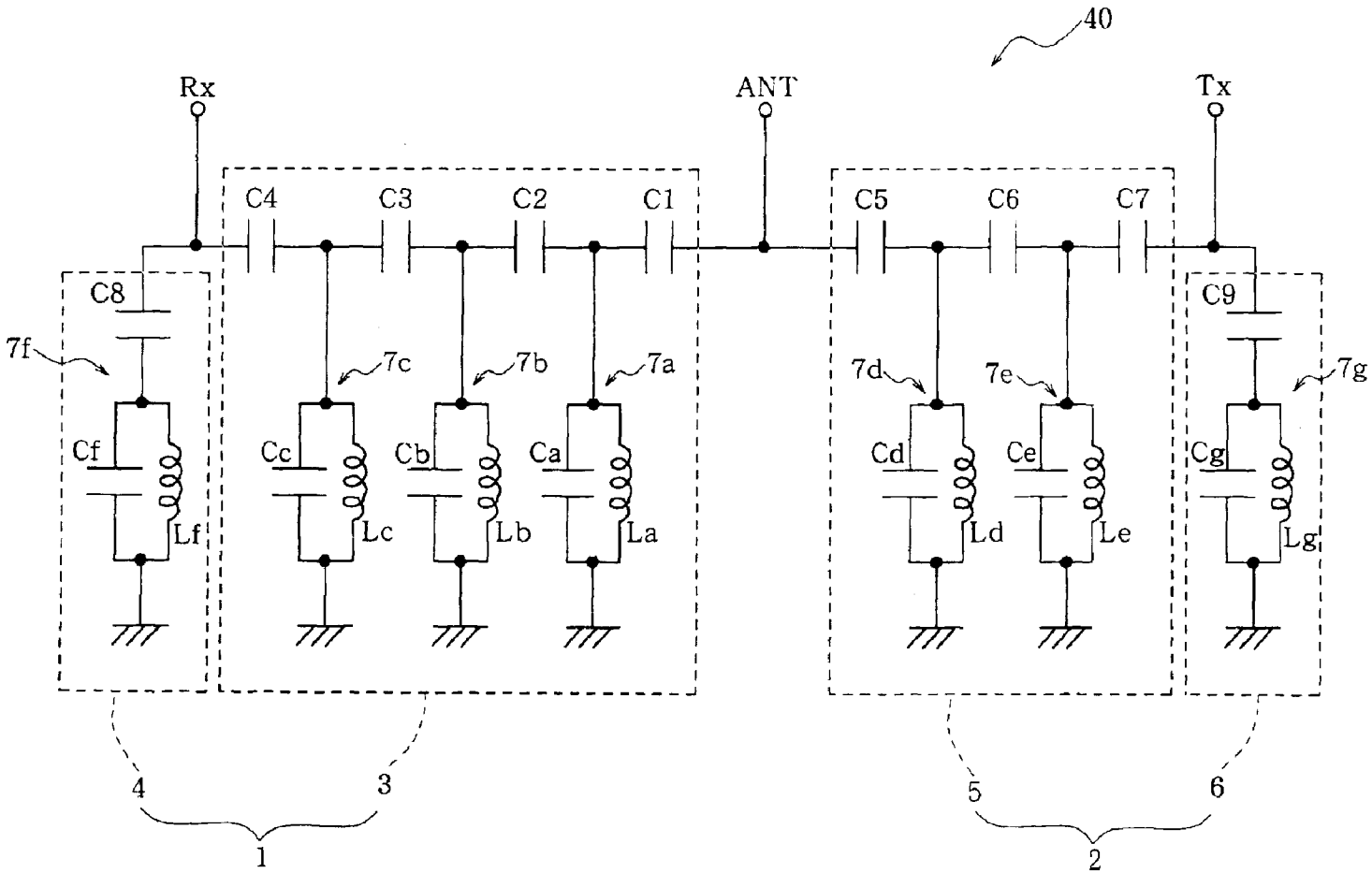
FIG. 11 is a diagram showing a circuit equivalent to the dielectric duplexer.
Figure 12:
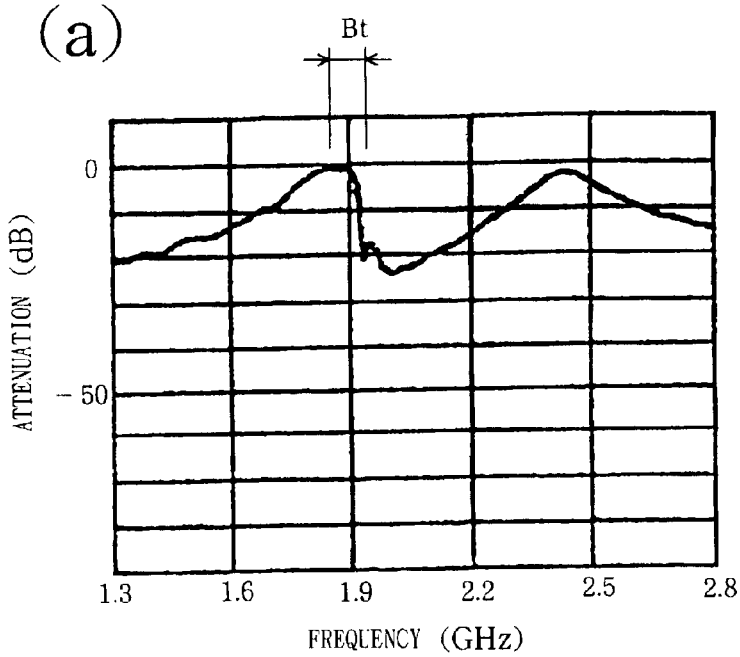
FIG. 12(*a*) is a graph showing the frequency characteristics of the conventional dielectric duplexer of FIG. 9 in operation for signal transmission.
Figure 12:
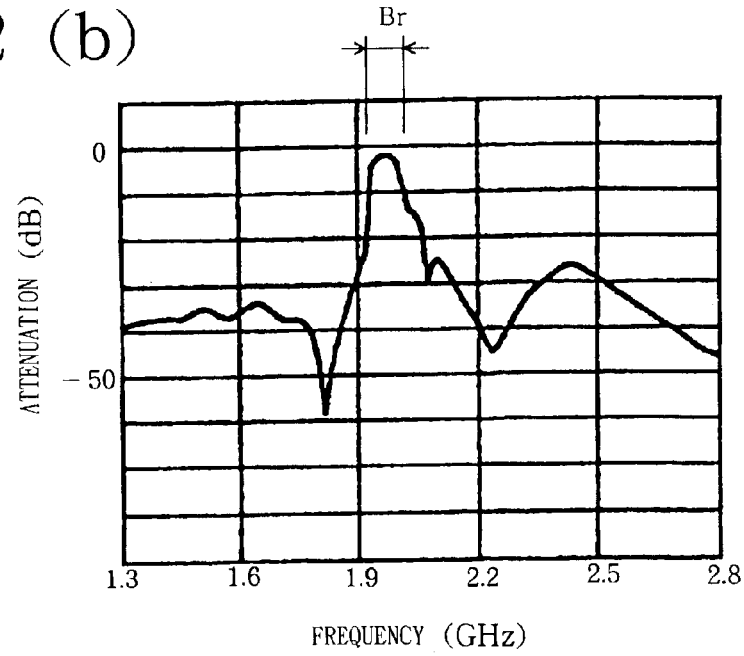

FIG. 12(*a*) and FIG. 12(*b*) show the frequency characteristics of the conventional dielectric duplexer 40 shown in FIG. 9 respectively in operation for signal transmission and in operation for signal receiving. As illustrated, the transmitting filter 2 gives pass characteristics in a predetermined transmission band Bt (1.85–1.91 GHz), and the receiving filter 1 affords pass characteristics in a predetermined receiving band Br (1.93–1.99 GHz).

Figure 13:
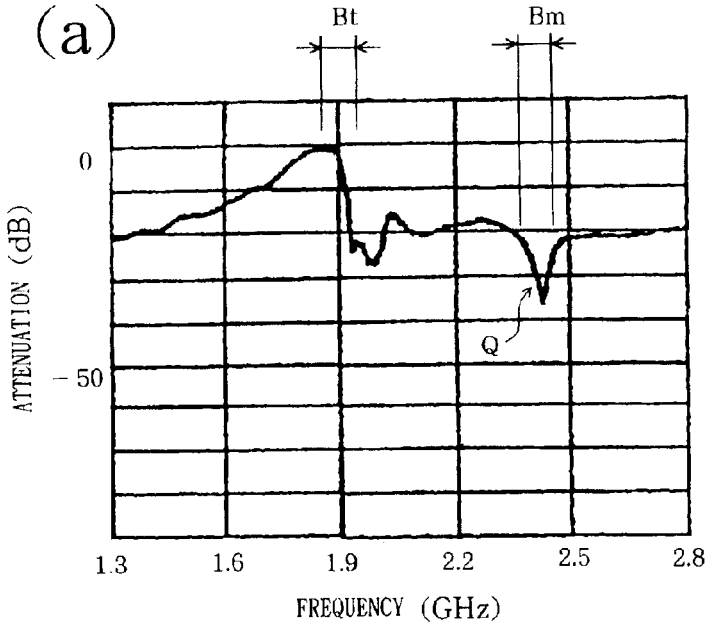
FIG. 13(*a*) is a graph showing the frequency characteristics of the dielectric duplexer of the invention shown in FIG. 1 in operation for signal transmission.
Figure 13:
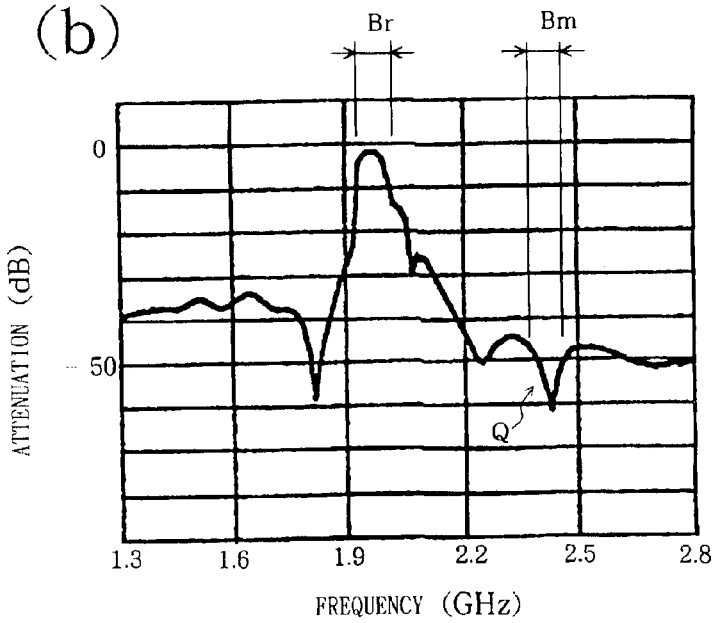

FIG. 13(*a*) and FIG. 13(*b*) show the frequency characteristics of the dielectric duplexer 10 shown in FIG. 1 respectively in operation for signal transmission and in operation for signal receiving. As illustrated, the trap circuit 8 produces an attenuation pole Q at a position away from the transmission band Bt and the receiving band Br, exhibiting trap characteristics in a frequency band including the operating band Bm (2.4045–2.4795 GHz) of the radio LAN. Unlike the characteristics of the conventional dielectric duplexer 40 shown in FIG. 12(*a*) and FIG. 12(*b*), a suppression effect of about 20 dB is available in the operating band Bm of the radio LAN during operation for both signal transmission and receiving. Incidentally, the dielectric duplexer 10 shown in FIG. 5 also exhibits nearly the same frequency characteristics as the duplexer 10 shown in FIG. 1.

Figure 14:
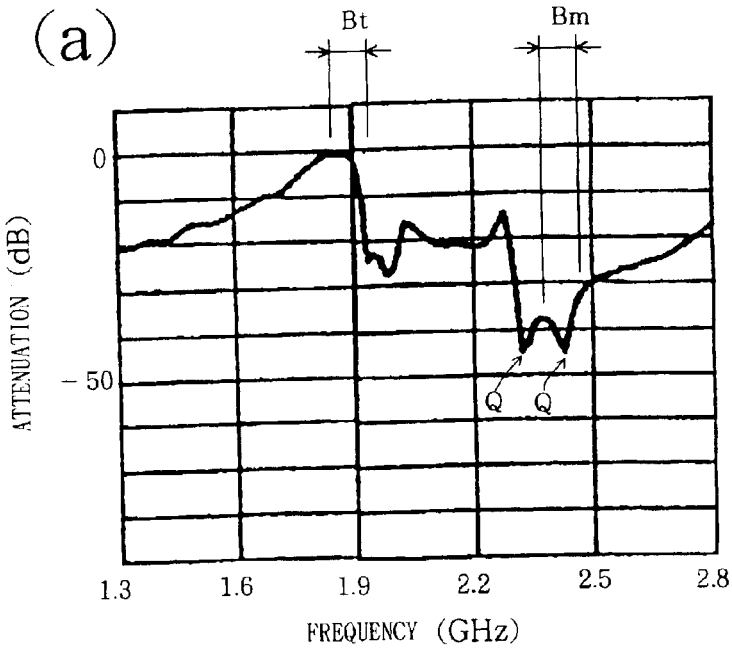
FIG. 14(*a*) is a graph showing the frequency characteristics of the dielectric duplexer of the invention shown in FIG. 4 in operation for signal transmission.
Figure 14:
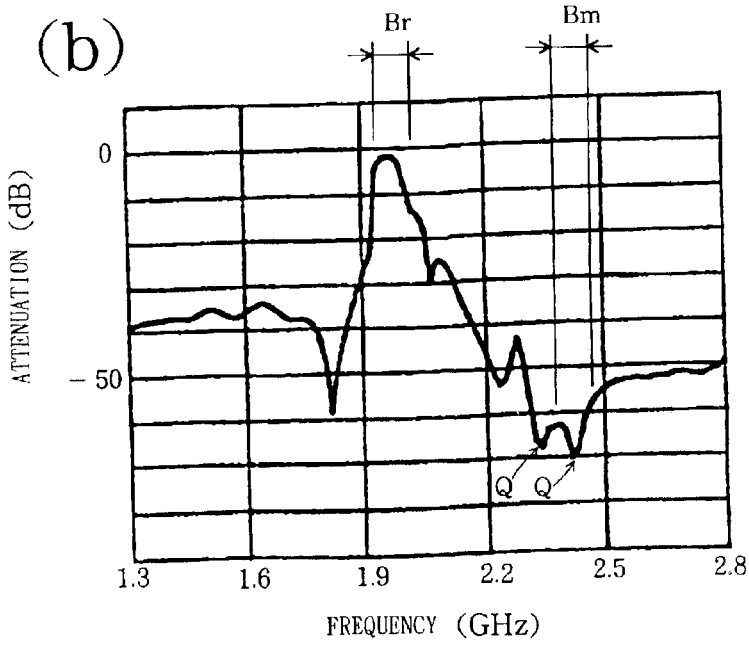
Figure 15:
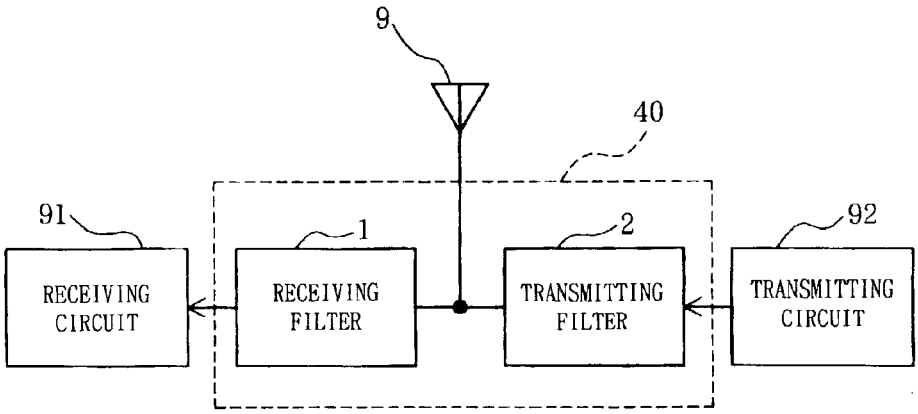
FIG. 15 is a block diagram showing the construction of a portable telephone.
Figure 16:
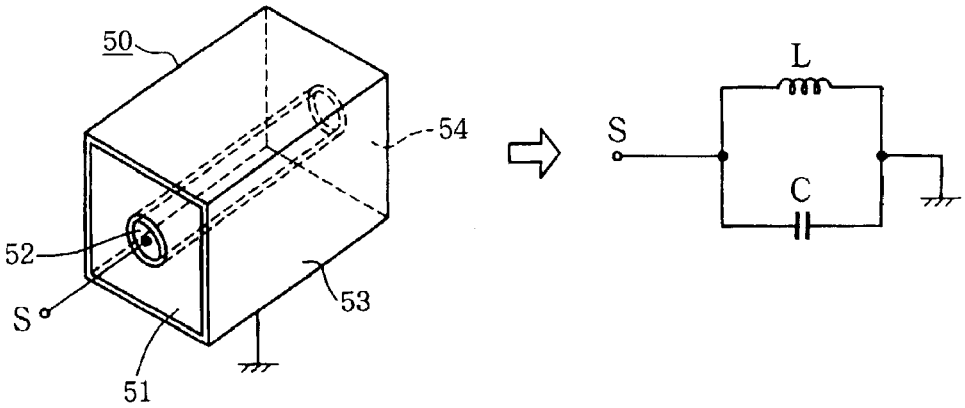
FIG. 16 includes a diagram showing the construction of a coaxial dielectric resonator and a diagram showing a circuit equivalent to the resonator.

FIG. 14(*a*) and FIG. 14(*b*) show the frequency characteristics of the dielectric duplexer 10 shown in FIG. 4 respectively in operation for signal transmission and in operation for signal receiving. As illustrated, the pair of trap circuits 8*a*, 8*b* produce two attenuation poles Q, Q at positions away from the transmission band Bt and the receiving band Br, exhibiting trap characteristics in a wide frequency band including the operating band Bm (2.4045–2.4795 GHz) of the radio LAN. Unlike the characteristics of the conventional dielectric duplexer 40 shown in FIG. 12(*a*) and FIG. 12(*b*), the duplexer 10 produces a suppression effect of about 35 to 36 dB in the operating band Bm of the radio LAN during operation for signal transmission and a suppression effect of about 37 to 38 dB in the band Bm during operation for signal receiving.

Consequently, with portable telephones equipped with the dielectric duplexer 10 of the invention, the signals received pass through the receiving filter 1, whereby the frequency components other than the receiving band are attenuated, with the operating band of the radio LAN suppressed by the trap circuit 8, so that the signals received exert no influence on the operation of the radio LAN.

Further transmission signals pass through the transmitting filter 2, whereby the frequency components other than the receiving band are attenuated, with the operating band of the radio LAN suppressed by the trap circuit 8, so that the operation of the radio LAN exerts no influence on the transmission signals.

Moreover, in the case of the portable telephones equipped with the dielectric duplexer 10 of the invention, the duplexer 10 of the monoblock type has integrally incorporated therein a trap circuit 8 which is used in common for signal transmission and for signal receiving, with the result that the duplexer 10 retains nearly the same chip size as in the prior art without entailing an increase in the size of the circuit board.

The duplexer of the present invention is not limited to the foregoing embodiments in construction, but the device can be modified variously by one skilled in the art without departing from the spirit of the invention as set forth in the appended claims.

What is claimed is:

1. A dielectric duplexer of the monoblock type comprising a receiving filter (1) and a transmitting filter (2) which are connected in parallel with an antenna connecting terminal portion (17), both the filters (1), (2) being integrally assembled into a common dielectric block (11), a trap circuit (8) being operable for suppressing a predetermined frequency band different from the receiving band of the receiving filter (1) and from the transmission band of the transmitting filter (2) and being integrally assembled into the dielectric block (11) along with the filters (1), (2), the trap circuit (8) being connected to the antenna connecting terminal portion (17).

2. A dielectric duplexer according to claim 1 wherein the receiving filter (1), the transmitting filter (2) and the trap circuit (8) each comprise one or a plurality of coaxial dielectric resonator portions (7), each of the resonator portions (7) comprising a dielectric block portion which is a part of the dielectric block (11), an inner conductor layer formed on an inner peripheral surface defining a bore extending through the dielectric block portion, an outer conductor layer formed on an outer peripheral surface of the dielectric block portion, and a short-circuiting conductor layer providing a short circuit between the inner conductor layer and the outer conductor layer.

3. A dielectric duplexer according to claim 2 wherein a conductor pattern piece is provided for each resonator portion (7) on the dielectric block (11) on one end face thereof where the bore of the resonator portion (7) has an opening, the conductor pattern piece being joined to the inner conductor layer, each pair of coaxial resonator portions (7), (7) to be connected to each other having their conductor pattern pieces positioned close to each other to provide a capacitance between the conductor pattern pieces for transmitting a high-frequency signal through the capacitance.

4. A dielectric duplexer according to claim 3 wherein the antenna connecting terminal portion (17) is joined to one end of the conductor pattern piece (31) formed on said one end face of the dielectric block (11), and the other end of the conductor pattern piece (31) is positioned close to the conductor pattern piece (30) of the coaxial dielectric resonator portion (7*t*) constituting the trap circuit (8) to produce between the conductor pattern pieces a capacitance for transmitting the high-frequency signal therethrough.

5. A dielectric duplexer according to claim 3 wherein the antenna connecting terminal portion (17) is joined to one end of the conductor pattern piece (31) formed on said one end face of the dielectric block (11), and the other end of the conductor pattern piece (31) is joined directly to the conductor pattern piece (30) of the coaxial dielectric resonator portion (7*t*) constituting the trap circuit (8).

6. A dielectric duplexer according to claim 1 wherein the antenna connecting terminal portion (17) has connected thereto a plurality of trap circuits (8*a*), (8*b*) for suppressing frequency bands which are different from each other.

* * * * *